US009624088B2

(12) United States Patent
Schroeder et al.

(10) Patent No.: US 9,624,088 B2
(45) Date of Patent: Apr. 18, 2017

(54) SAFETY INTERLOCK NOZZLE

(71) Applicants: Timothy G. Schroeder, St. Louis, MO (US); Arthur C. Fink, Lonedell, MO (US)

(72) Inventors: Timothy G. Schroeder, St. Louis, MO (US); Arthur C. Fink, Lonedell, MO (US)

(73) Assignee: Husky Corporation, Pacific, MO (US)

( * ) Notice: Subject to any disclaimer, the term of this patent is extended or adjusted under 35 U.S.C. 154(b) by 14 days.

(21) Appl. No.: 14/544,705

(22) Filed: Feb. 9, 2015

(65) Prior Publication Data

US 2015/0232321 A1 Aug. 20, 2015

Related U.S. Application Data

(60) Provisional application No. 61/966,146, filed on Feb. 18, 2014.

(51) Int. Cl.

| | |
|---|---|
| ***B67D 7/54*** | (2010.01) |
| ***B67D 7/00*** | (2010.01) |
| ***B67D 7/32*** | (2010.01) |

(52) U.S. Cl.

CPC ..... *B67D 7/54* (2013.01); *B67D 7/005* (2013.01); *B67D 7/3209* (2013.01); *B67D 2007/545* (2013.01)

(58) Field of Classification Search

CPC ... B67D 7/06; B67D 7/44; B67D 7/54; B67D 2007/545; B67C 3/264

USPC ..... 141/206–209, 351–355, 392

See application file for complete search history.

(56) References Cited

U.S. PATENT DOCUMENTS

| | | | | | |
|---|---|---|---|---|---|
| 1,938,479 | A | | 12/1933 | Baker | |
| 3,502,121 | A | | 3/1970 | Moore et al. | |
| 3,719,215 | A | | 3/1973 | Murray | |
| 3,982,571 | A | | 9/1976 | Fenton et al. | |
| 4,060,110 | A | | 11/1977 | Bower | |
| 4,143,689 | A | | 3/1979 | Conley et al. | |
| D261,674 | S | | 11/1981 | Nice | |
| 4,557,302 | A | * | 12/1985 | Sunderhaus | B67D 7/54 141/207 |
| 4,697,624 | A | | 10/1987 | Bower et al. | |
| D293,462 | S | | 12/1987 | Bower et al. | |
| 5,000,360 | A | | 3/1991 | Lown et al. | |
| 5,067,639 | A | | 11/1991 | Maguire et al. | |
| 5,085,258 | A | * | 2/1992 | Fink, Jr. | B67D 7/48 141/206 |
| 5,121,777 | A | | 6/1992 | Leininger et al. | |

(Continued)

*Primary Examiner* — Timothy L Maust
*Assistant Examiner* — Timothy P Kelly
(74) *Attorney, Agent, or Firm* — Paul M. Denk

(57) ABSTRACT

A safety interlock nozzle for use with a safety interlock mechanism is disclosed which comprises a base having an interlock contact surface at a first end and alternating tabs at a second end, a body having alternating tabs at a first end that mate with the alternating tabs of the base, a channel within the body positioned at a second end, a ring clamp for connecting the tabs of the base to the tabs of the body, a splash guard having a first end for contacting with a filler neck housing and a second end having a slot formed therein, the second end capable of fitting within the channel of the second end of the body, and a spring for being captured within the channel in the body and the slot within the splash guard, the spring for connecting the splash guard to the body.

24 Claims, 5 Drawing Sheets

(56) References Cited

U.S. PATENT DOCUMENTS

| | | | | |
|---|---|---|---|---|
| 5,390,712 | A | 2/1995 | Parrish et al. | |
| 5,417,259 | A | 5/1995 | Schneider | |
| 5,469,900 | A | 11/1995 | Weeks et al. | |
| 5,645,116 | A | 7/1997 | McDonald | |
| 5,713,401 | A | 2/1998 | Weeks | |
| D420,364 | S | 2/2000 | Fischer et al. | |
| 7,406,988 | B2 | 8/2008 | Mitchell | |
| 8,066,037 | B2 | 11/2011 | Lawrence et al. | |
| D668,953 | S | 10/2012 | Maxwell | |
| 8,800,611 | B2 | 8/2014 | Tsiberidis | |
| D719,826 | S | 12/2014 | Burnside | |
| 8,997,804 | B2 * | 4/2015 | Grantham ..... | B67D 7/54 141/353 |
| D739,442 | S | 9/2015 | Schroeder et al. | |

* cited by examiner

SAFETY INTERLOCK NOZZLE

CROSS REFERENCE TO RELATED APPLICATION

This non-provisional patent application claims priority to the provisional application having Ser. No. 61/966,146, filed on Feb. 18, 2014.

FIELD OF THE INVENTION

This disclosure generally relates to a fuel dispensing nozzle, and more particularly, to a fuel dispensing nozzle incorporating a safety feature that shuts off the flow of fuel when the nozzle is removed from the fill pipe or neck of a vehicle. Another significant feature of the concept of this invention is to provide for a reduction in the amount of force necessary for the application of the nozzle within a vehicle for refueling.

BACKGROUND OF THE INVENTION

Gasoline fuel dispensing nozzles are used to control the flow of fuel, such as gasoline or gasoline blended with ethanol, from a storage tank through a fill pipe into a gasoline tank in a vehicle. In order to facilitate the rapid and efficient dispensing of the fuel from a storage tank to a user tank, fuel dispensing systems are designed to operate at a very high fluid flow rate. The fuel is pumped from the storage tank and through a dispensing metering system that tracks and records the amount of fuel dispensed by each user. The fuel then flows through a fuel line from the metering system to a dispensing nozzle that is placed in a fuel inlet or fuel filler neck attached to the user tank to enable the dispensing of fuel from the storage tank into the user tank.

The dispensing nozzle that is used to dispense fuel may have a safety interlock mechanism incorporated therein. The safety interlock mechanism will immediately stop the flow of gasoline if the fuel dispensing nozzle is accidentally removed from the fill neck prior to the tank being full. The nozzle may contain a bellows device that is placed over a spout that is inserted into the fill neck. By placing the spout into the fill neck a force is exerted on the bellows device that moves the bellows device to initiate operation of the interlock mechanism. Removal of the spout prior to the tank being full releases the force on the bellows device and operates the interlock mechanism to shutoff fuel flow. The bellows device is constructed of a hard material that requires a large force to move the bellows device to operate the interlock mechanism. The force that is required is so large that elderly individuals find it difficult to use the nozzle to refuel a vehicle. To complicate matters, the force required to engage the interlock mechanism increases at lower temperatures. Thus, bellows type devices are perceived as being difficult to operate, large, heavy, and bulky. As known, the bellows style of balanced pressure fuel dispensing is used to provide a return of vapors back to the underground storage tank, primarily through the pressure that builds up within the fuel tank as gasoline is being dispensed therein. That pressure returns the vapors back through the bellows, its nozzle, and the dispenser to the underground storage tank.

Further, some governmental regulatory agencies require that a nozzle have a vapor recovery system integrated with the nozzle so that any vapors inside the fuel tank of the vehicle are allowed to flow back through the nozzle and into an underground storage tank. Such nozzles, in order to comply with various regulations, must function to shutoff both fuel delivery and provide vapor recovery during refueling and in the event that the nozzle is inadvertently removed from a fill pipe of a vehicle. However, due to recent regulations, nozzles having vapor recovery systems are being phased out. Also, due to a large number of new vehicles being equipped with on-board refueling vapor recovery systems (ORVR), the extra level of safety gained from vapor recovery interlock nozzles will be reduced. Therefore, there is the potential for nozzle manufacturers to produce nozzles which do not have expensive vapor recovery interlock systems incorporated therein.

The present disclosure is designed to obviate and overcome many of the disadvantages and shortcomings experienced with prior nozzles having a safety interlock mechanism for dispensing fuel. Moreover, the present disclosure is related to a safety interlock nozzle that is designed and constructed to be easier to operate, from a force standpoint, than prior nozzles having a safety interlock mechanism. The present disclosure utilizes different structure, to assure that the nozzle always remains off, until such time as the spout is properly and conveniently located within the fill pipe of the vehicle, before the fuel can be dispensed. The present disclosure further provides different structure to immediately shutoff fuel flow if the nozzle is inadvertently, accidentally, untimely, or even negligently removed from the fill pipe of the vehicle before the tank is full.

SUMMARY OF THE INVENTION

The present disclosure is a safety interlock nozzle for use with a safety interlock mechanism which incorporates structure that forms a base having an interlock contact surface at a first end and alternating tabs at a second end, a body having alternating tabs at a first end that mate with the alternating tabs of the base, a channel within the body positioned at a second end, a ring clamp for connecting the tabs of the base to the tabs of the body, a splash guard have a first end for contacting with a filler neck housing of a second end having a slot formed therein, the second end capable of fitting within the channel of the second end of the body, and a spring for being captured within the channel in the body and the slot within the splash guard, the spring for connecting the splash guard to the body.

Another unique aspect of this invention is that the splash guard of the body has at least a compound surface, which could even be an arcuate surface, and which provides a centralized line of contact with the fill pipe of the vehicle, so that there is simply a line of contact, and not an entire surface area, which has been found to substantially reduce the force necessary to contract the body within the base, in telescoping fashion, as the nozzle and these structural components are inserted into the vehicle fill pipe, in preparation for a refueling of the vehicle. As previously stated, it is the desire to obtain through the usage of this invention a force of less than 5 lbs. pressure, to contract the nozzle when it is inserted into the vehicle fill pipe, and through that maneuver disengage the automatic shutoff valve, to allow for its operations, during the fueling of a vehicle, as known in the art. This feature of disengaging the automatic shutoff mechanism of the nozzle, to achieve refueling, has generally been described in the previous U.S. Pat. No. 7,406,988, owned by a common assignee.

In another form of the present disclosure, a safety interlock nozzle for use with a safety interlock mechanism comprises a base having an interlock contact surface at a first end and alternating tabs at a second end, a body having alternating tabs at a first end that mate with the alternating tabs of the base, a channel within the body positioned at a second end, a ring clamp for connecting the tabs of the base to the tabs of the body, a splash guard having a first end for contacting with a filler neck housing of a vehicle, a second annular end having a slot formed therein, the second end capable of fitting within the channel of the second end of the body, and a spacer ring formed integrally within the second end for receiving and generally centering the spout there through, and a spring for being captured within the channel in the body and the slot within the splash guard, the spring for connecting the splash guard to the body.

In yet another form of the present disclosure, a safety interlock nozzle for use with a safety interlock mechanism is disclosed which comprises a base having an interlock contact surface at a first end and alternating tabs at a second end, a body having alternating tabs at a first end that mate with the alternating tabs of the base, a channel within the body positioned at a second end, a ring clamp for connecting the tabs of the base to the tabs of the body, a splash guard having a first end for contacting with a filler neck housing of a vehicle, a second end having a slot formed therein, the second end capable of fitting within the channel of the second end of the body, an exterior surface having an upper friction bearing surface and a lower friction bearing surface, and a spring for being captured within the channel in the body and the slot within the splash guard, the spring for connecting the splash guard to the body.

The present disclosure is directed to a safety interlock nozzle that has a safety interlock mechanism that can be actuated by the application of a low level of force. The low level of force may be the application below a maximum of five lbs.

The present disclosure provides a safety interlock nozzle that is simple to operate and provides highly reliable results to dispense fuel at a rapid flow rate.

The present disclosure provides a safety interlock nozzle that has a straight telescoping interlock assembly instead of a compressible bellows design.

The present disclosure is also directed to a safety interlock nozzle that may be constructed of a material or materials that can transfer a force or a load in an axial direction independent of operating temperatures.

The present disclosure further provides a safety interlock nozzle that is compatible with, and can be readily incorporated into, existing dispensing nozzles, without the need to reconfigure or modify the existing nozzle design.

The present disclosure provides a safety interlock nozzle that has a safety interlock assembly that is easy to remove from the nozzle for service or replacement.

These and other advantages of the present disclosure will become more apparent to those skilled in the art after considering the following detailed specification in conjunction with the accompanying drawings.

DESCRIPTION OF THE PREFERRED EMBODIMENT

Figure 1:
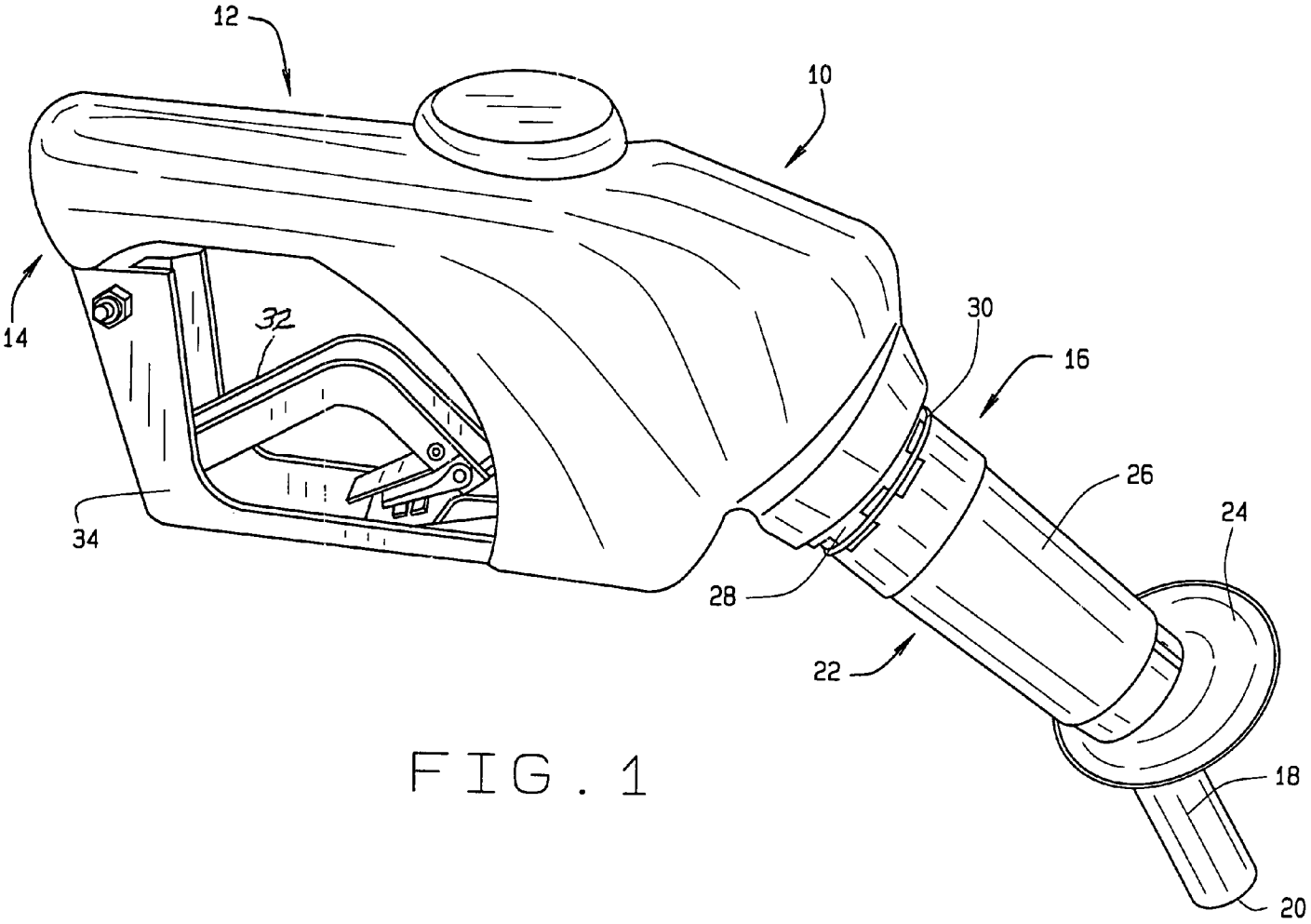
FIG. 1 is a perspective side view of a safety interlock nozzle constructed according to the present disclosure.

Referring now to the drawings, wherein like numbers refer to like items, number 10 identifies a preferred embodiment of a safety interlock nozzle constructed according to the present disclosure. With reference now to FIG. 1, the safety interlock nozzle 10 is shown to comprise a body 12 having an inlet 14 provided at its backend and to which the fuel hose (not shown) is connected. The nozzle 10 also has an outlet 16 having a spout 18. The spout 18 has a mouth 20 that may be inserted into an inlet of a container, such as the fill pipe or neck of a fuel tank (all of which are not shown) into which gasoline or fuel is to be dispensed. The nozzle 10 also has a safety interlock assembly 22 that has a splash guard 24 positioned near the outlet 16 of the spout 18, a body portion 26, a base portion 28, and a fastener or ring clamp 30. The safety interlock assembly 22 is capable of longitudinal or axial movements upon the spout 18 in order to actuate interconnected components (not shown in this figure) housed within the nozzle 10. Again, see U.S. Pat. No. 7,406,988. The safety interlock nozzle 10 also has an operating lever or handles 32 that are used to open or close the poppet of the nozzle 10. A handle guard 34 has the handle 32 enclosed therein. As can be appreciated, when fuel needs to be dispensed from one storage tank to another, or into a vehicle, the nozzle 10 is used. The spout 18 is placed into the fill pipe of a receiving fuel tank and the splash guard 24 is pressed against a filler neck. The force generated by placing the splash guard 24 against a filler neck will push the body portion 26 and the base portion 28 upwardly, which will release the automatic shutoff to operate internally of the nozzle 10. Once the valve is operated, the handle 32 may be operated or squeezed. This will allow fuel to flow from a storage tank into the receiving tank. The splash guard 24, the body 26, and the base 28 may be constructed of plastic or metal, as desired. For the sake of clarity, various other known internal components of the nozzle 10 have not been discussed or illustrated.

Figure 2:
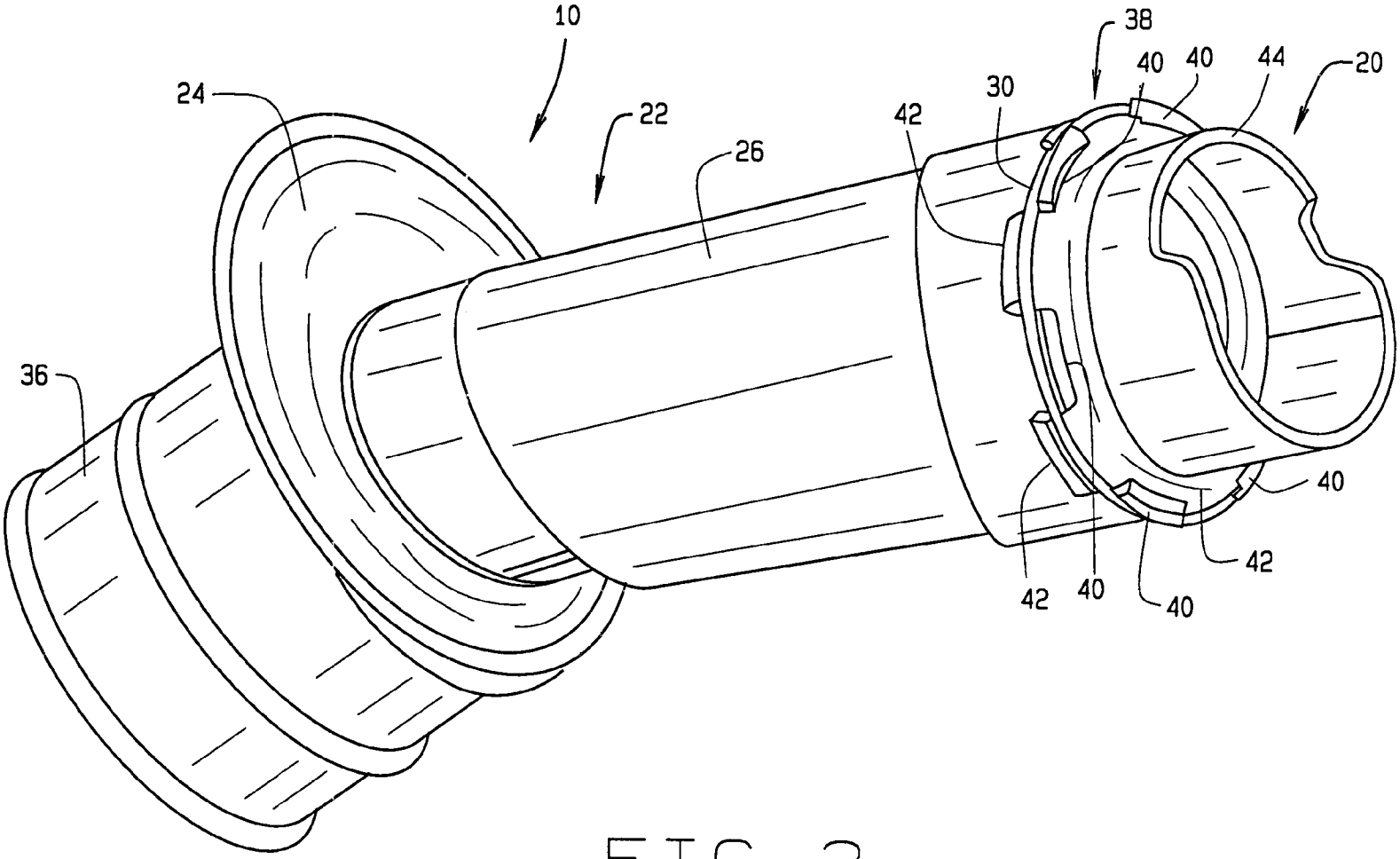
FIG. 2 is a perspective side view of a safety interlock assembly constructed according to the present disclosure being removed from a spout.

FIG. 2 shows the safety interlock assembly 22 removed from the spout 18 to illustrate various components of the assembly 22. The splash guard 24 of the safety interlock assembly 22 is shown being adjacent to a filler neck portion or housing 36 that is typically part of a vehicle fuel tank (not shown). The filler neck portion or housing 36 is not part of the assembly 22, but is shown to depict how the splash guard 24 is aligned or engaged with the housing 36. The splash guard 24 is used to eliminate accidental fuel spillage on the hands, shoes, or clothing of an individual or on the ground. The body portion 26 provides a guide for the splash guard 24 and is movable along the spout 18. The assembly 22 has a back end 38 that has a plurality of interlocking members or tabs 40 that alternate with a plurality of interlocking members or tabs 42 of the base portion 28. The ring clamp 30 is used to secure the body portion 26 to the base portion 28 by fitting into the tabs or connectors 40 and 42. The ring clamp 30 also allows the body portion 26 to be easily removed from the base portion 28 when the assembly 22 needs to be removed for service. The base portion 28 has an interlock pin contact surface 44 that engages a pin or a rod member (not shown) that controls an automatic shutoff (not shown) within the nozzle 10 that is used to shutoff the flow of fuel when the vehicle fuel tank is filled. In particular, if the poppet valve is operated then the flow of fuel through the nozzle 10 will be allowed to be deposited through the fill pipe into a gas tank. The automatic shutoff will shutoff fuel flow when the fuel tank is filled and or when the nozzle 10 has been removed, either by accident or inadvertently, from the fill pipe.

Figure 3:
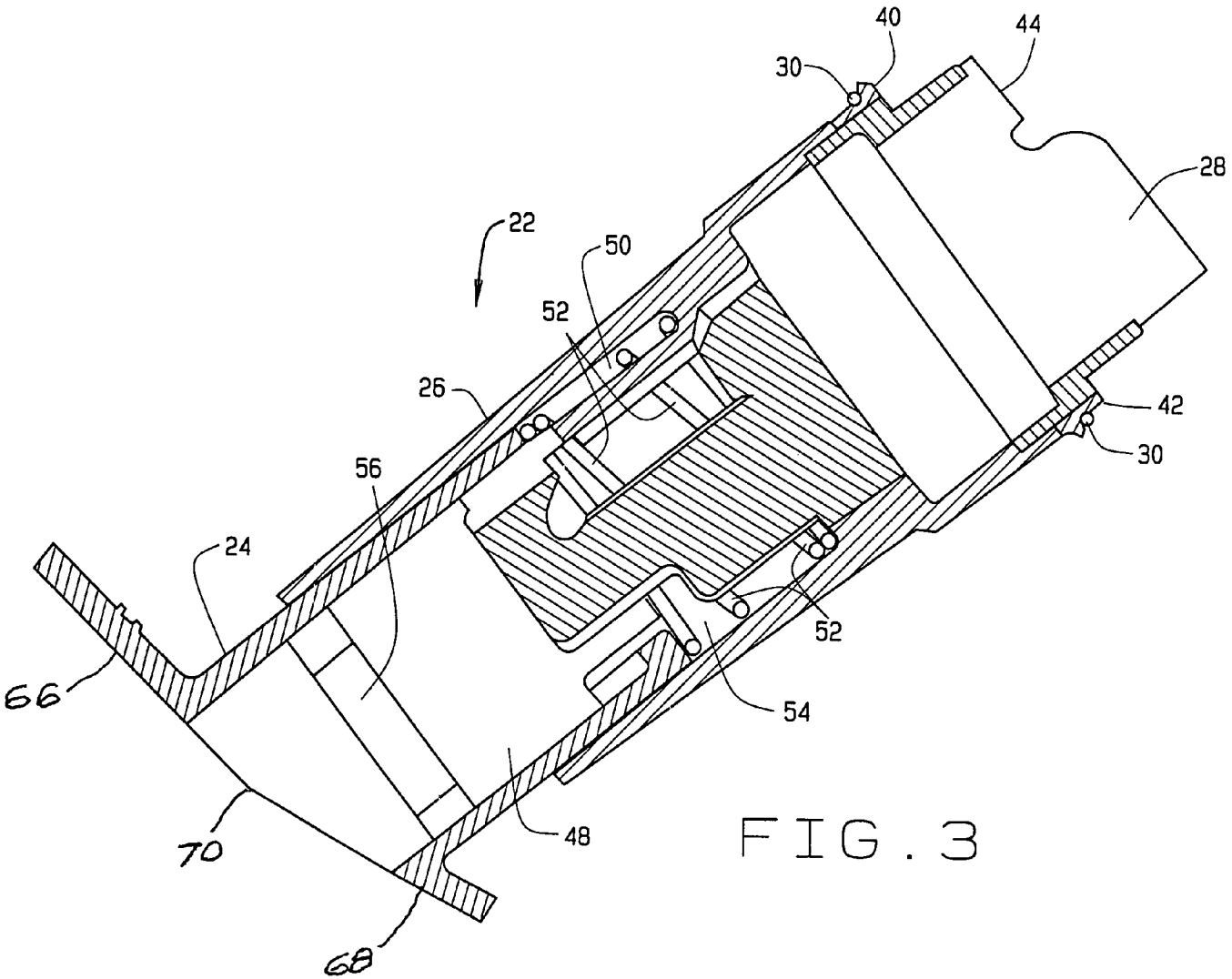
FIG. 3 is a cross-sectional view of the safety interlock assembly.

Referring now to FIG. 3, a cross-sectional view of the safety interlock assembly 22 is shown. The safety interlock assembly 22 has the splash guard 24 having an annular or upper end 48 that fits within the body portion 26, in a telescopic fit, and is capable of sliding or axial movement therein. The body portion 26 has a channel 50 within which the end 48 fits. A spring 52 is captured within the channel 50. The spring 52 is also captured by the splash guard 24 in a slot 54. The spring 52 is inserted into the channel 50 and the slot 54 in a bayonet style method to securely attach the splash guard 24 to the body portion 26. In this manner, the spring 52 is used to prevent the splash guard 24 from separating from the body portion 26 when in use. The spring 52 also prevents the body portion 26 from rotating. The spring 52 provides a torsional force that keeps the splash guard 24 in place and prevents accidental loosening of the splash guard 24. The spring 52 further accommodates all styles of fuel filler housings by adjusting to different distances between the fill neck lip and the spout ring detent on the fuel filler housing. As long as the fuel filler housing is built according to SAE J1140 specifications, the distance between the fill neck lip and the spout ring detent should be between 4.0 mm and 13.0 mm.

The splash guard 24 also has an internal spacer ring 56 incorporated therein. The spacer ring 56 is used to reduce or eliminate looseness and rattling between the spout 18 and the interlock assembly 22 once the interlock assembly 22 is connected to the nozzle body 12. The spacer ring 56 is integral with the splash guard 24 and is generally circular in shape. This spacer ring helps to center the nozzle spout within the assembly. The spacer ring 56 also acts as a guide to assist in keeping the direction of the actuation force along a center line of the spout 18.

As can be noted in FIG. 3, the splash guard 24 provides a compound surface 66 and 68 that forms a horizontal ridgeline, as at 70, that extends transversely across the splash guard. Thus, with the spout of the nozzle being centered within the splash guard, as the nozzle spout is inserted within the fill pipe of a vehicle, this ridgeline 70 comes into contact with the opening of the fill pipe, and therefore, minimizes the contact between the nozzle assembly, and the vehicle, in preparation for fuel dispensing. It has been found that the use of this ridge type of line across the splash guard significantly lessens the amount of force needed to compress the splash guard within the body portion 26, and in most instances, lessens the force necessary to operate the assembly to less than 5 lbs. of pressure. Obviously, other compound shapes could be used for the surface of the splash guard, such as one that may be formed vertically, or even the surface of the splash guard may have an arcuate shape, and thereby still minimize the contact surface of the splash guard with the fill pipe, to reduce the force necessary to achieve functioning of this assembly on the fuel dispensing nozzle.

The assembly 22 is also shown having the ring clamp 30 being used to secure the body portion 26 to the base portion 28 by fitting into the tabs 40 and 42. The base portion 28 also has the interlock pin contact surface 44 that is used to engage a pin or a rod member (not shown) to control an automatic shutoff (not shown) within the nozzle 10 that is used to curtail the flow of fuel. Movement of the pin or rod member operates or sets the shutoff which will also allow the nozzle to be operated. Further, if the pin or rod member is operated again, which correlates to the nozzle 10 being removed prior to the tank being filled, and then the valve will operate to immediately stop the flow of fuel through the nozzle 10.

Figure 4:
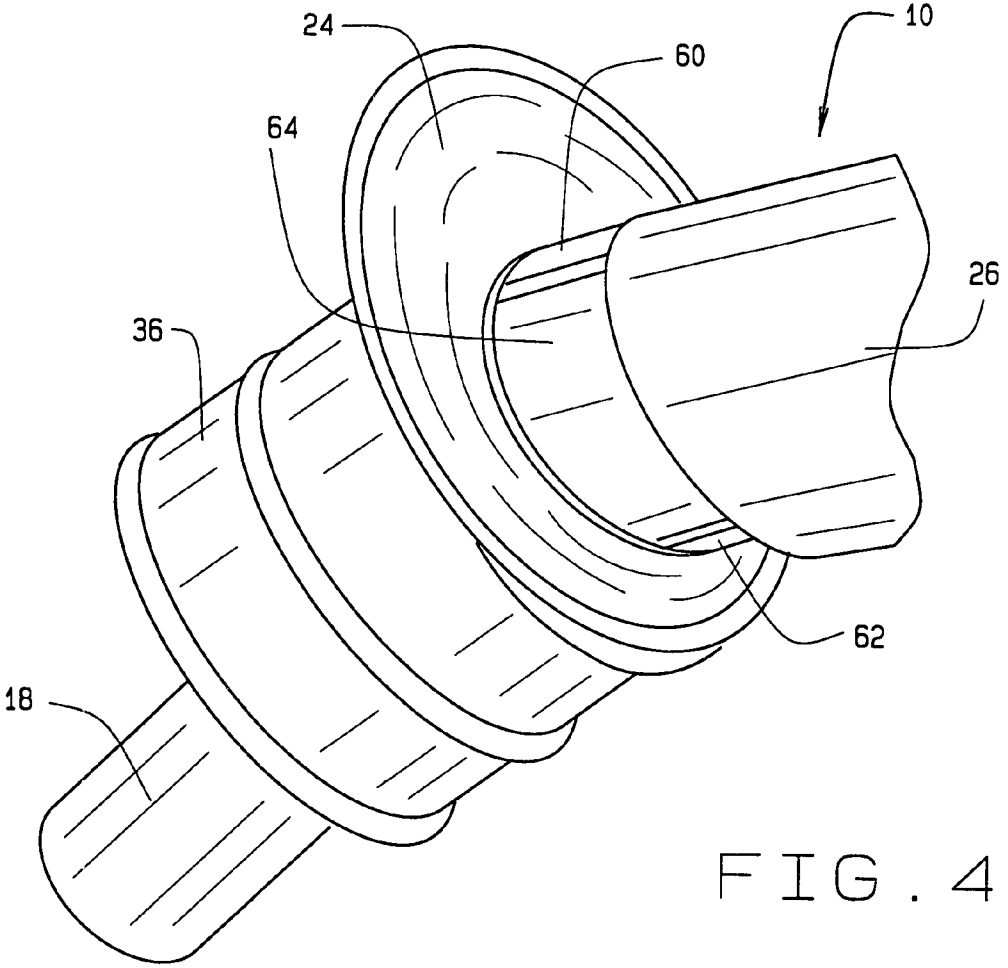
FIG. 4 is partial perspective view of the safety interlock assembly illustrating an upper friction bearing surface and a lower friction bearing surface of a splash guard.

FIG. 4 shows a partial view of the safety interlock nozzle 10 being inserted into the fill pipe housing 36 and the spout 18 being inserted through the fill pipe housing 36. The neck between the housing 36 and the fuel tank are not shown in this particular view. The splash guard 24 has an upper slight friction bearing surface 60 and a lower slight friction bearing surface 62 formed around a circular exterior side 64. The surfaces 60 and 62 are raised surfaces and are the only points where the splash guard 24 and the body 26 will transfer any load when the nozzle 10 is inserted into the housing 36. With the use of the surfaces 60 and 62, friction is only allowed to occur between the splash guard 24 and the body 26 at the top and bottom of the splash guard 24. These two surfaces 60 and 62 control where friction may develop and provides better control over actuation forces necessary to operate the contact surface 44. These surfaces 60 and 62 have a tendency to keep the splash guard aligned with respect to the body portion 26, and therefore, maintain the proper alignment of the splash guard when it is inserted into the fill pipe of the vehicle. Furthermore, it is preferable to keep the contact point 70 of the splash guard generally transverse, with the vehicle fill pipe, to assure that it is the only point of contact between the two, which has that beneficial effect of lessening the amount of force necessary to insert the nozzle into the vehicle, in preparation for refueling.

Figure 5:
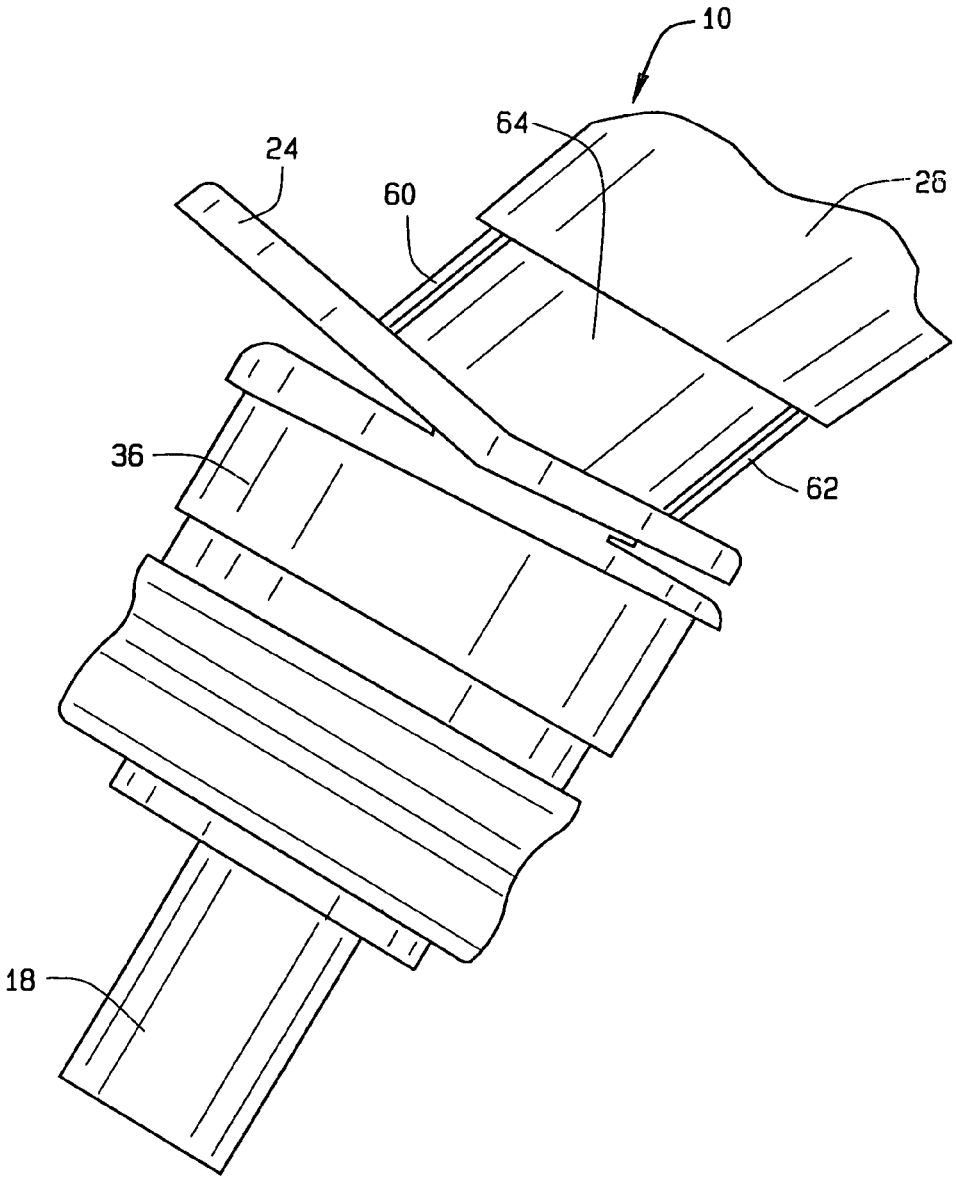
FIG. 5 is a partial perspective side view of the safety interlock nozzle illustrating a connection between the splash guard and a fill pipe portion.

With particular reference now to FIG. 5, a partial side view of the safety interlock nozzle 10 is shown being inserted into the housing 36 and the spout 18 being inserted through the housing 36. The splash guard 24 is shown contacting the housing 36 and this point of contact transfers a force back to the nozzle 10 and the contact surface 44 to operate the internal valve. The contacting of the splash guard 24 with the housing 36 is in line or closely in line with a center line of the spout 18. This keeps the actuation force from acting though a moment arm which can cause the interlock assembly 22 to bind up or require a higher actuation force. Thus, while the splash guard and its line of contact 70 engages the fill pipe of the vehicle, on insertion of the nozzle therein, once the assembly has been actuated, the nozzle will probably tilt slightly downwardly, which brings the splash guard surface 68 against the surface of the shown housing 36, during refueling.

Thus, as can be determined, when the nozzle 10 is not being used, and the assembly 22 is at its steady state condition, the assembly 22 is shifted forwardly of the spout 18, allowing the contact surface 44 to be shifted forwardly and not in contact with a safety interlock mechanism within the nozzle 10. Under this circumstance, the automatic shutoff is disengaged and the handle 32 cannot be squeezed or maneuvered to the on position. However, when the nozzle 10 is applied into the fill pipe housing 36 of an automobile, or any vehicle, or even a container, the splash guard 24, the body 26, the base 28, and the contact surface 44 will be compressed rearward. Normally the spout of the nozzle will be retained within the fill pipe when inserted. Due to the pressure exerted upon the assembly 22, the contact surface 44 will force the safety interlock mechanism of the shutoff within the nozzle 10 into engagement. When this occurs, the handle 32 may be operated to allow for the initiation of fluid flow. Operation of the handle 32 will open a poppet mechanism (not shown) within the nozzle 10 to allow fluid, such as gasoline, to flow through the nozzle 10, and be dispensed into the gasoline tank of the vehicle in which the nozzle 10 is inserted. During the fueling operation if the nozzle 10 is removed from the housing 36, the force or pressure exerted on the assembly 22 will be removed which will cause the contact surface 44 to move forward. This will operate the safety interlock mechanism and immediately shutoff the nozzle 10 and the flow of fuel through the nozzle 10. Such an interlock is shown in the Company's U.S. Pat. No. 7,406,988.

From all that has been said, it will be clear that there has thus been shown and described herein a safety interlock nozzle. It will become apparent to those skilled in the art, however, that many changes, modifications, variations, and other uses and applications of the subject safety interlock nozzle are possible and contemplated. All changes, modifications, variations, and other uses and applications which do not depart from the spirit and scope of the disclosure are deemed to be covered by the disclosure, which is limited only by the claims which follow.

We claim:

1. A safety interlock nozzle for use with a safety interlock mechanism comprising:

a base having an interlock contact surface at a first end and alternating tabs at a second end, and said body is a straight body;

a body having alternating tabs at a first end that mate with the alternating tabs of the base, a channel within the body positioned at a second end;

a ring clamp for connecting the tabs of the base to the tabs of the body;

a splash guard having a first end for contacting with a filler neck housing of a vehicle, a second end having an annular end formed therein, the second end capable of fitting within the channel of the second end of the body, and a spacer ring formed integrally within the second end for receiving a spout therethrough, said spout being maintained centrally within said body and said spacer ring when applied therein;

said splash guard, the body, and the base are constructed of rigid material;

a spring being captured within the channel in the body, said spring for connecting the splash guard to the body, and a lock means securing said splash guard to said body; and wherein said splash guard has a surface that provides a line of contact between the splash guard and the filler neck housing of the vehicle to be fueled.

2. The safety interlock nozzle of claim 1 wherein the splash guard exerts a force on the spring when the first end of the splash guard contacts the filler neck housing.

3. The safety interlock nozzle of claim 1 wherein the splash guard is capable of sliding into the body for biasing against the spring.

4. The safety interlock nozzle of claim 1 wherein the splash guard, the spacer ring, the body, and the base are constructed of plastic.

5. The safety interlock nozzle of claim 1 wherein the spring prevents the splash guard from rotating relative to the body.

6. The safety interlock nozzle of claim 1 wherein the spring prevents the splash guard from separating from the body.

7. A safety interlock nozzle incorporating a safety interlock mechanism comprising:

a base having an interlock contact surface at a first end and alternating tabs at a second end;

a body having alternating tabs at a first end that mate with the alternating tabs of the base, a channel within the body positioned at a second end, and said body is a straight body;

a ring clamp for connected the tabs of the base to the tabs of the body;

a splash guard having a first end for contacting with a filler neck housing of a vehicle, a second upper end having an annular end formed therein, the second end capable of fitting within the channel of the second end of the body, an exterior surface having an upper friction bearing surface and a lower friction bearing surface;

a spring for being captured within the channel in the body and against the splash guard, the spring for connecting the splash guard to the body;

said splash guard, the body, and the base are constructed of rigid plastic; and wherein said splash guard has a surface that provides a line of contact between the splash guard and the filler neck housing of the vehicle to thereby minimize the contact between the safety interlock nozzle and the vehicle and thereby lesson the force necessary to operate the assembly to less than five pounds of pressure.

8. The safety interlock nozzle of claim 7 wherein the upper friction bearing surface is a raised surface.

9. The safety interlock nozzle of claim 7 wherein the lower friction bearing surface is a raised surface.

10. The safety interlock nozzle of claim 7 wherein the spring prevents the splash guard from separating from the body.

11. The safety interlock nozzle of claim 7 wherein the nozzle is used to dispense fuel from a fuel storage tank into a fuel tank of a vehicle, the nozzle having an inlet end and a spout having an outlet end, said safety interlock mechanism provided within the nozzle for shutting off fuel flow when the safety interlock mechanism is actuated, and the interlock contact surface of said base provided for contacting the safety interlock mechanism.

12. A safety interlock nozzle for use with a safety interlock mechanism comprising:

a base having an interlock contact surface at a first end and first connectors at a second end;

a body having second connectors at a first end that mate with said first connectors of the base, a channel within the body positioned at a second end, and said body is a straight body;

a fastener for securing the first connectors of the base to the second connectors of the body;

a splash guard having a first end for contacting with a filler neck housing of a vehicle, a second end having a cylindrical form, the second end capable of fitting within the channel of the second end of the body;

said splash guard, the body, and the base are constructed of rigid material; and a spring for being captured within the channel in the body and against the cylindrical form of the second end of the splash guard, the spring for connecting the splash guard to the body.

13. The safety interlock nozzle of claim 12 wherein the form of the second cylindrical end of the splash guard provides for a bayonet locking within the channel of the body.

14. A safety interlock nozzle incorporating a safety interlock mechanism comprising:

a base, said base at its first end contacting the interlock mechanism;

a body, said body having a first end and integrating with the base, and a channel provided within the body, and said body is a straight body;

a splash guard having a first end for contacting with a filler neck housing of a vehicle, and a second end having an upper end formed thereat, the second end capable of fitting within the channel of the body;

said splash guard, the body, and the base are constructed of rigid material; and a spring provided within the body channel and capable of connecting the splash guard to the body and to allow for axial shifting of the splash guard in said body.

15. The safety interlock nozzle of claim 14, wherein splash guard has a surface that provides a line of contact between the splash guard and the filler neck housing of the vehicle.

16. The safety interlock nozzle of claim 15, and including a spacer ring provided within the splash guard, said spacer ring provided for centering a nozzle spout therein, to assure that the splash guard retains proper alignment with any vehicle filler neck when the nozzle is inserted within the vehicle for a refueling.

17. The safety interlock nozzle of claim 16, wherein the body, the splash guard, and the spacer ring furnishes a line of contact between the splash guard and the filler neck of the vehicle when the safety interlock nozzle is inserted therein for refueling, and thereby reduces the amount of pressure necessary to shift the interlock mechanism for actuation of the safety interlock of the nozzle to provide for its fueling of the vehicle.

18. The safety interlock nozzle of claim 17, wherein the force required to compress the assembly during insertion of the safety interlock nozzle within the filler neck of the vehicle is less than 5 lbs. of force.

19. The safety interlock nozzle of claim 16, wherein said body having an approximate center line, and said splash guard, and said spacer ring provided for alignment with the center line of the channel provided within the body.

20. The safety interlock nozzle of claim 14, wherein said base also having a connecting device at a second end, the body having a connecting device at a first end that mates with the connecting device of the base, and a connector for securing the connecting device of the base to the connecting device of the body to secure the same together.

21. The safety interlock nozzle of claim 20, wherein said connector comprising a clamp ring, said clamp ring securing the connecting device of the base with the connecting device of the body, for securing said base and body together.

22. A safety interlock nozzle for use with a safety interlock mechanism:

a base having an interlock contact surface at a first end and alternating tabs at a second end;

a body having alternating tabs at a first end that mate with the alternating tabs of the base, a channel within the body positioned at a second end;

a ring clamp for connecting the tabs of the base to the tabs of the body;

a splash guard having a first end for contacting with a filler neck housing of a vehicle, and a second end having an upper end formed thereon, the second end capable of fitting within the channel of the second end of the body;

a spring for being captured within the channel of the body and the second end of the splash guard, the spring for connecting the splash guard with the body;

said body is straight;

wherein the splash guard exerts a force of less than five pounds on the spring when the first end of the splash guard contacts the filler neck housing, for initiating actuation of the nozzle interlock;

said splash guard is capable of sliding into the body for biasing against said spring;

said splash guard, the body, and the base are constructed of rigid plastic;

wherein when said nozzle spout is inserted within the fill pipe of the vehicle, said splash guard forms a single line of contact with the opening of the fill pipe and thereby minimizes the contact between the splash guard of the safety interlock nozzle and the vehicle in preparation for fuel dispensing.

23. The safety interlock nozzle of claim 22 wherein the spring prevents the splash guard from rotating relative to the body.

24. The safety interlock nozzle of claim 22 wherein the spring prevents the splash guard from separating from the body.

* * * * *